US005704221A

United States Patent [19]

Lego

[11] Patent Number: 5,704,221

[45] Date of Patent: Jan. 6, 1998

[54] REFRIGERATION EXCHANGER, METHOD FOR CONTROL THEREOF AND COOLING INSTALLATION INCLUDING SUCH EXCHANGER

[75] Inventor: Francois Lego, Ste-Luce, France

[73] Assignee: McInternational, Velizy, France

[21] Appl. No.: 652,533

[22] PCT Filed: Nov. 30, 1994

[86] PCT No.: PCT/FR94/01401

§ 371 Date: Jul. 2, 1996

§ 102(e) Date: Jul. 2, 1996

[87] PCT Pub. No.: WO95/15467

PCT Pub. Date: Jun. 8, 1995

[30] Foreign Application Priority Data

Dec. 2, 1993 [FR] France ..... 93 14460

[51] Int. Cl.[6] ..... F25B 5/02; F25D 21/08; F25D 17/06

[52] U.S. Cl. ..... 62/278; 62/80; 62/276; 62/525

[58] Field of Search ..... 62/80, 81, 272, 62/276, 278, 404, 285, 283, 524, 525

[56] References Cited

U.S. PATENT DOCUMENTS

| | | | |
|---|---|---|---|
| 3,150,498 | 9/1964 | Blake | 62/278 |
| 3,499,295 | 3/1970 | Brennan | 62/81 |
| 3,529,436 | 9/1970 | Brennan | 62/80 |
| 3,572,052 | 3/1971 | Toth | 62/278 |
| 4,122,686 | 10/1978 | Lindahl et al. | 62/81 |
| 4,122,688 | 10/1978 | Mochizuki et al. | 62/278 |
| 4,302,945 | 12/1981 | Bell | 62/81 |
| 4,369,350 | 1/1983 | Kobayashi et al. | 219/201 |
| 4,407,137 | 10/1983 | Hayes | 62/80 |
| 4,691,527 | 9/1987 | Ikeda | 62/234 |
| 4,987,747 | 1/1991 | Nakamura et al. | 62/160 |

*Primary Examiner*—William Doerrler
*Attorney, Agent, or Firm*—Young & Thompson

[57] ABSTRACT

A refrigerating exchanger (1) for a refrigeration facility such as a cold storage room or a refrigerated display case, including a refrigerant or heat-removing fluid circulating assembly (5) connected to a heat exchanging assembly (6) with a large surface area. The assemblies (5, 6) form an array of several layers (7) and several rows (8) in the form of a plurality of mutually similar parallel members (9) separated by spacers (10) for providing heat insulation and collecting defrosting runoff water. Each member (9) comprises at least one layer (7) as well as a respective inlet (11) and outlet (12) forming part of the circulating assembly (5). At least three members (9) of the array each have a refrigerating capacity that is a fraction of the overall standard rating of the exchanger (1) so that at any one time during the operation of the exchanger (1), at least one of the members (9) can be in defrosting mode while at least two of the members (9) are in refrigerating mode, the members (9) being in turn in defrosting mode and in refrigerating mode.

16 Claims, 3 Drawing Sheets

REFRIGERATION EXCHANGER, METHOD FOR CONTROL THEREOF AND COOLING INSTALLATION INCLUDING SUCH EXCHANGER

FIELD OF THE INVENTION

This invention relates to a refrigerating exchanger, a method for control thereof and a cooling installation including such exchanger.

The cooling installation may be a refrigerating chamber, a chill or quick-freezing room, a refrigerated display cabinet, a refrigerated display case or the like.

Such an installation includes a cabinet which defines an enclosure wherein a given-low-temperature must be kept. Therefore, air circulation means are provided, which are suitable for circulating air within such enclosure and at least one refrigerating exchanger which a refrigerating or cool transfer fluid passes through.

Such an exchanger is typically in the form of a battery with several layers and several rows.

BACKGROUND OF THE INVENTION

According to document U.S. Pat. No. 5,031,413, the battery is arranged in two similar elements, connected in parallel, and separated by means of partitions. Each element has its own air flow and its own fan. Such structure makes it possible to keep a satisfactory relative humidity, since the evaporators are always operated on an alternative basis.

Document GB-A-2,164,133 also relates to a structure which tends to keep a satisfactory relative humidity in a refrigerated display case. The structure comprises two evaporators connected in parallel, with one providing for a cooling function and the other one providing for a humidifying function.

Document U.S. Pat. No. 4,373,353 discloses an air-conditioning installation including a plurality of evaporators aiming at avoiding the overload of the compressor.

SUMMARY OF THE INVENTION

This invention aims at providing for the defrosting of an exchanger in a cooling installation while simultaneously keeping an acceptable cooling temperature complying with the requirements in the enclosure which such installation is associated with, while avoiding a refrigerating output in excess with respect to the needs.

As a matter of fact, a rise in temperature resulting from the defrosting, which would be disadvantageous if too high should be avoided, more particularly so if the products stored in the enclosure are heat sensitive.

It is further advisable, for cost-saving reasons, that the refrigerating output of the installation does not exceed the actual needs by far.

Therefore, this invention provides, according to a first aspect, a refrigerating exchanger such as previously mentioned, wherein the battery comprises at least three elements, each having a refrigerating output which is a fraction of the entire exchanger nominal output, so as to allow for at least one of the elements to be defrosting, at a given time of the exchanger operation, and for at least two of the elements to be cold-producing, the elements being, in turn, defrosting or cold-producing.

According to another feature, the exchanger, which includes heat exchanging means, further includes air circulation means on the heat exchanging means so arranged as to form a common air flow at the battery inlet and a common air flow at the battery outlet.

Alternatively, and according to still another feature of the invention, the exchanger also comprises selective air circulation or non-circulation means on the heat exchanging means of each element in such a manner that the air circulation is authorised for some elements and not authorised for the other elements.

Such selective means are associated with control means. Air circulation is authorised for the cold-producing elements and is not authorised for the defrosting elements. Heating of the heat exchanging means, for each element, is provided in such a manner that it is activated for an element for which air circulation is not authorised and to be inactivated for an element for which air circulation is authorised.

According to a second aspect, this invention relates to a method of control of such exchanger, wherein:

- in a given cycle N of the exchanger operation, two at least of the cold-producing elements are made operational, while one at least of the elements is defrosting;
- when the defrosting operation of the defrosting element(s) is completed or sufficient, another similar cycle N+1 is started, wherein one or more cold-producing element(s) in cycle N are switched to defrosting operation while the defrosting element(s) in cycle N are switched to cold-producing operation.

According to a third aspect, the invention relates to a cooling installation which comprises a refrigerating exchanger controlled by the above-mentioned method, on the one hand, and a circuit for the refrigerant or the cool transfer fluid, located between the inlets and outlets of the battery elements, on the other hand.

Such an installation includes selective refrigerant or cool transfer fluid circulation or non-circulation means in each element of the battery, in such a manner that circulation is authorised for the cold-producing elements and not authorised for the defrosting element(s).

Such selective means comprise valves or similar and means controlling said valves.

The refrigerant or cool transfer fluid circuit includes at least partly several branches connected in parallel, whose number is equal to that of the battery elements, i.e. one branch per element.

In a first possible embodiment, it is provided for, partly several branches connected in parallel, and partly one single branch or one single bundle composed of several branches. According to another embodiment, the entire circuit includes several branches connected in parallel.

In the case of an installation intended for a refrigerant fluid, an expansion valve common to several elements, and more particularly, one single expansion valve connected to one single branch of the circuit, can be provided.

In such case, a refrigerant fluid manifold distributor is interposed between such single branch, downstream from the expansion valve and the plurality of branches upstream from the selective circulation or non-circulation means.

BRIEF DESCRIPTION OF THE INVENTION

The other features of the invention will result from the subsequent disclosure, with reference to the enclosed drawings in which.

Figure 2:
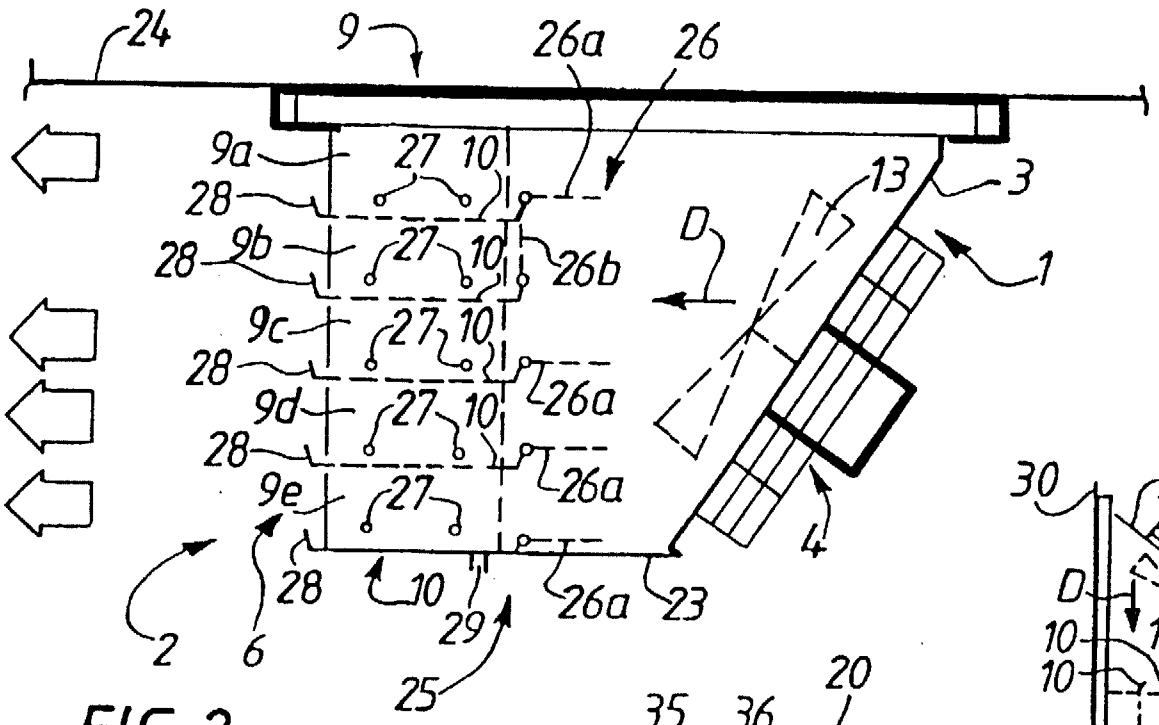
FIG. 2 is a schematic vertical view of an exchanger to be set on the ceiling of a chill room, having a negative temperature, according to one alternative embodiment of the invention.
Figure 2A:
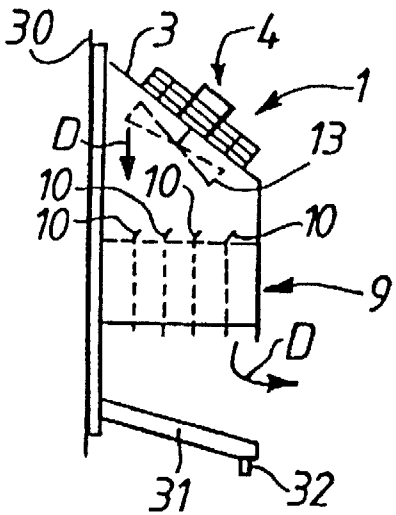
Figure 3:
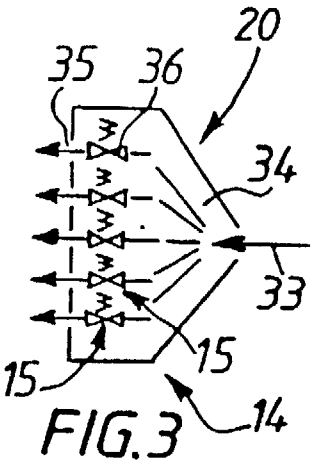
Figure 4:
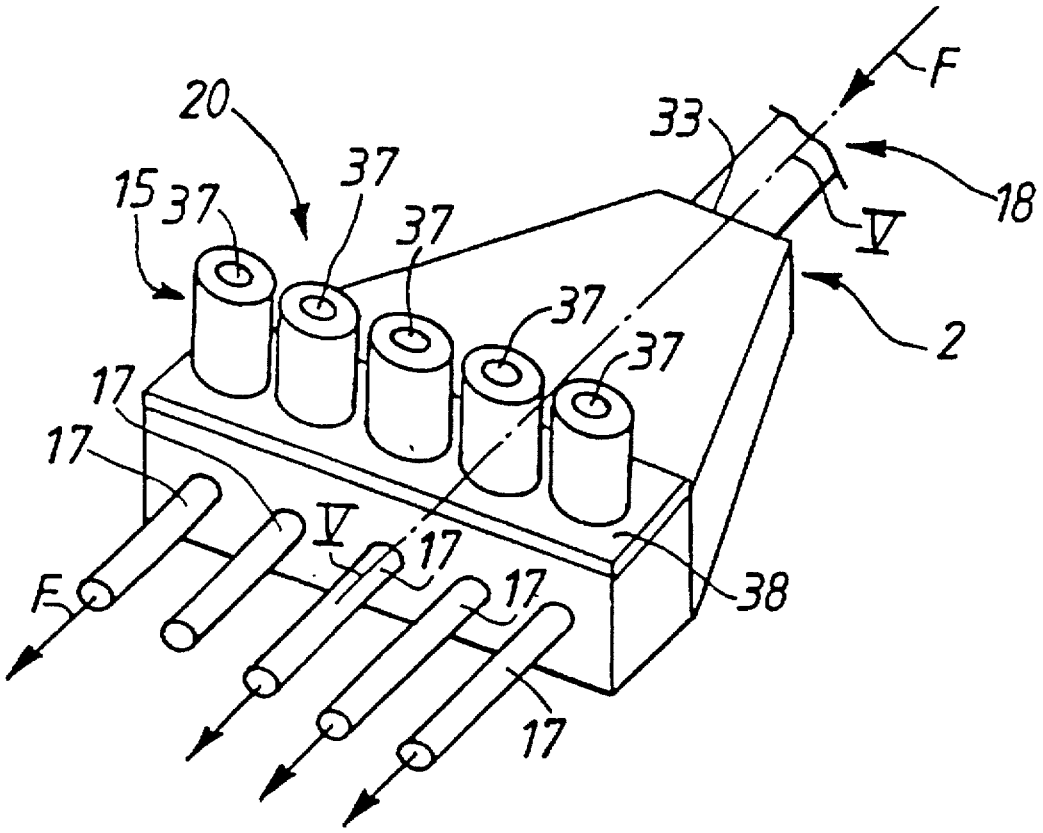
Figure 5:
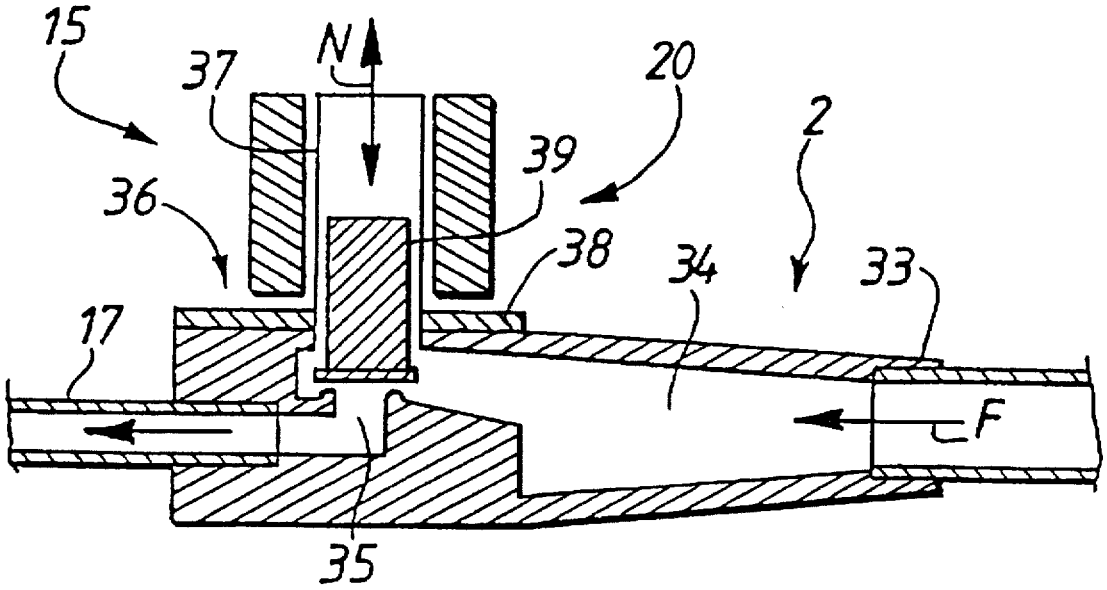

FIG. 2*a* is a view similar to FIG. 2, and shows another embodiment of such alternative solution;

FIG. 3 is a schematic sectional view of a built-in valves manifold distributor for an installation according to this invention;

FIG. 4 is a perspective view of an embodiment of the manifold distributor;

FIG. 5 is an axial section view along line V—V of FIG. 4.

DETAILED DESCRIPTION OF THE INVENTION

A cooling installation according to the invention comprises a refrigerating exchanger 1 and a circuit 2 for the refrigerant or cool transfer fluid circulating in exchanger 1.

Such an installation is aimed at being associated with a cooling enclosure 3. Air circulation means 4 are suitable for circulating air in enclosure 3, while passing it through exchanger 1. Such means 4 may comprise a fan 13.

Of course, another gas can be used, instead of air.

Figure 1:
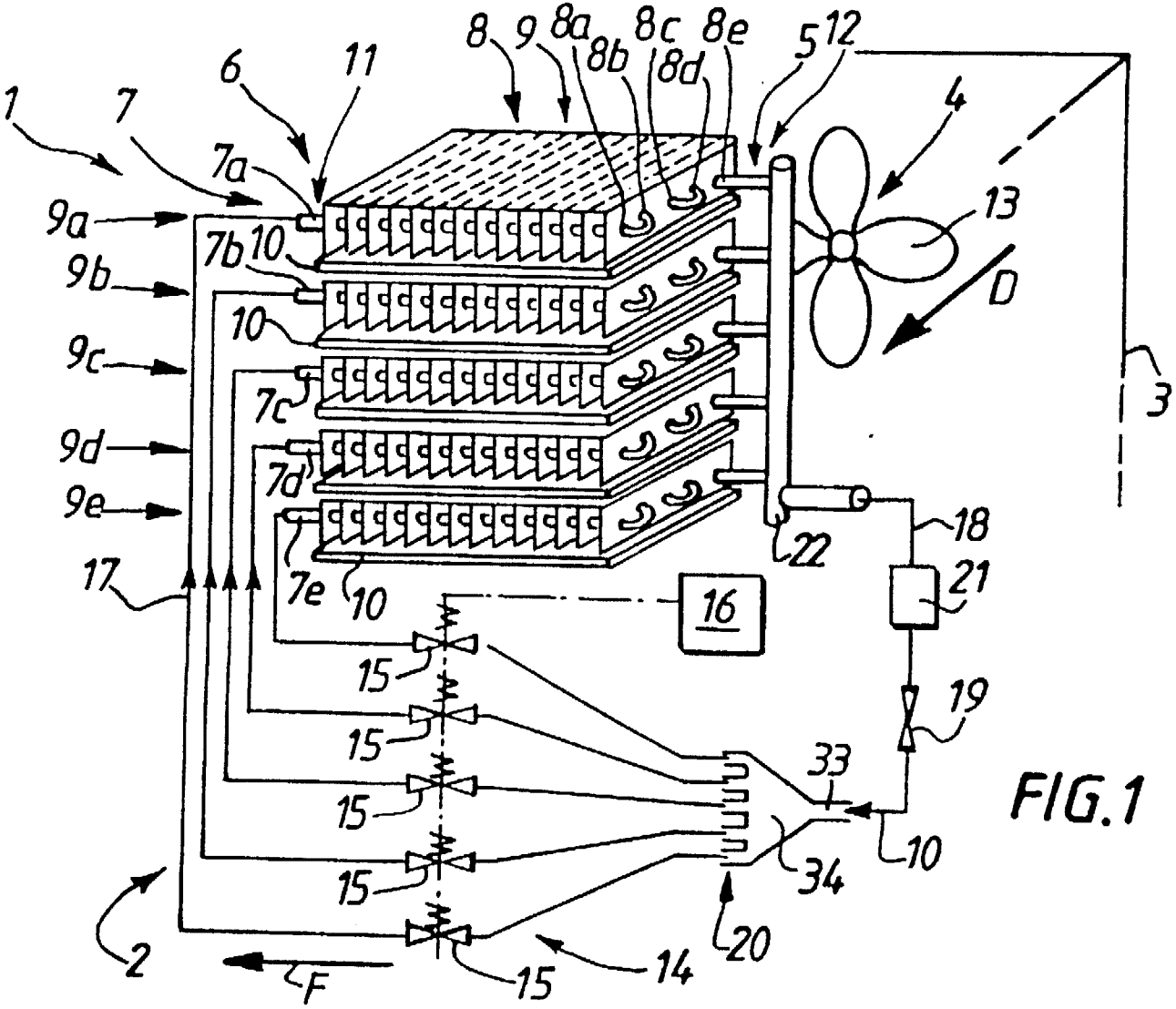
FIG. 1 is a schematic perspective view of a part of the cooling installation according to the invention.

The cooling enclosure 3 may be a chill room, a quick-freezing room, a refrigerated display cabinet, a refrigerated display case or any other similar disposition. Such enclosure 3 can be brought to a temperature of the order of a few degree centigrade, e.g. typically in the region of 2° C. for the application to the preservation of fresh foodstuff (FIG. 1). In other applications, the temperature in enclosure 3 can be negative (FIG. 2).

The refrigerating exchanger 1 comprises refrigerating or cool transfer fluid circulation means 5, in the form of tubes. With means 5 are associated heat exchanging means 6, which have a large surface. Such means 6 are, for example, successive blades spaced from each other and transversally connected around the tubes of means 5.

The refrigerating or cool transfer fluid circulation means 5, and the heat exchanging means 6 are disposed in the form of a battery having several layers 7 and several rows 8.

In the embodiment shown in FIG. 1, five layers 7*a*, 7*b*, 7*c*, 7*d* and 7*e* and five rows 8*a*, 8*b*, 8*c*, 8*d* and 8*e* are provided. In FIG. 1, layers 7A through 7*e* are substantially located horizontally. Rows 8*a* through 8*e* are substantially located vertically.

Such layers 7 and rows 8 are arranged into a plurality of elements 9 which are structurally similar to one another, and which form the battery.

In the embodiment of FIG. 1, five elements 9*a*, 9*b*, 9*c*, 9*d* and 9*e* are provided, corresponding to a layer 7*a*, 7*b*, 7*c*, 7*d* end 7*e*, respectively. Each element comprises five rows 8*a*, 8*b*, 8*c*, 8*d* and 8*e*.

The elements 9 are connected in parallel with respect to means 5. They constitute a compact assembly and are separated from one another by partitions 10. More particularly, the heat exchanging means 6 are separated from one another for the various elements 9 in such a manner as to avoid any heat bridge between them.

Separations 10 provide some heat insulation between the elements 9. They also provide the collection of water resulting from defrosting so as to prevent them from flowing into an adjacent element. Therefore, separations 10 can be in the form of solid plates having a good heat insulation capacity. Preferably, there exists no heat bridge between separations 10 and heat exchanging means 6.

Separations 10 are disposed substantially horizontally or slightly inclined with respect to a horizontal line to facilitate the flowing of defrosting water.

Although FIG. 1 shows the case of one element including one single layer 7, it must be understood that the invention can be applied when each element 9 includes several layers 7.

Each element 9 comprises its own inlet 11 and outlet 12, which belong to the refrigerating or cool transfer fluid circulation means 5, with a view to facilitating the connection in parallel of such elements 9.

The battery 5, 6 which has just been disclosed forms a unitary entirety, the elements 9 which compose it being placed side by side.

The battery 5, 6 comprises at least three elements 9.

Each element 9 has a refrigerating output which is a fraction only of the entire exchanger nominal output.

By refrigerating output of the element 9 is meant the refrigerating output that such element is capable of providing under normal operating conditions.

By entire nominal output of the exchanger 1 is meant the output of the exchanger under normal operating conditions. Such conditions are such that the exchanger makes it possible to reach the requested temperature in enclosure 3.

Thus, at a given moment during the operation of exchanger 1, et least one of the elements 9 can be defrosting, and at least two of the elements 9 can be cold-producing. The elements 9 are defrosting or cold-producing, in turn. The refrigerating output developed by all the cold-producing elements 9 corresponds to the refrigerating output required for the enclosure 3 to be at the required temperature.

In the case of a battery 5, 6 including three elements 9, each element 9 is arranged so as to have an output equal to half the entire nominal output of the exchanger. As a matter of fact, two elements 9 are operated together.

Where the battery 5, 6 includes four elements 9, each element 9 has an output equal to one third of the entire nominal output of the exchanger.

In the case shown in FIG. 1, where five elements 9 have been provided, with four cold-producing elements and one defrosting element, each element 9 has an output equal to one quarter of the entire nominal output of the exchanger.

More generally, in the preferential case of a battery 5, 6 having n elements 9, among which n−1 are cold-producing and one is defrosting, the refrigerating output of each element 9 is equal to P/n−1, where P is the entire nominal output of the exchanger 1. In such case, each element 9 is defrosting for one cycle every n cycle and cold-producing for n−1 cycle every n cycle.

The air circulation means 4 provide the passage of air on the heat exchanging means 6. Such means 4 are so arranged as to define and form an air flow which is common to the various elements 9 at the battery 5,6 inlet as well as outlet.

Accordingly, the air flow at the inlet and at the outlet is not shared according to the elements 9.

One or more fans 13 are provided and interposed on the air flow common to the battery 5,6 inlet and/or outlet. When several fans are provided, they all affect the common air flow.

One exchanger 1 as has just been disclosed is controlled as follows:

For a given operating cycle N, at least two elements 9 are made operational for cold-production while at least one element 9 is defrosting.

When the defrosting operation of the defrosting element (s) 9 is completed or sufficient, another similar cycle N+1 is started.

In cycle N+1, one or several elements 9 which are cold-producing during cycle N are switched to defrosting. Conversely, the element(s) 9 which are defrosting during cycle N are switched to cold-producing.

The control of the exchanger is repeated according to such process, until each element 9 has been defrosting at least once.

Upon completion of the above, the control process is repeated.

The switching from cycle N to the following cycle N+1 is controlled either through a previous adjustment of the duration of each cycle, or through a control bound with the operation of the exchanger 1 or of the installation which it is incorporated in, and more particularly the defrosting degree of the heat exchanging means 6. In such second case, the duration of the successive cycles can be different.

The control process which has just been disclosed normally applies when the installation has been operating for some time, and one or several elements 9 have frost on the corresponding heat exchanging means 6.

When starting the exchanger 1, and the installation which includes it, no element 9 has frost. Besides, the temperature in enclosure 3 is generally higher than under normal operating conditions, and this requests a higher refrigerating output or a longer cooling time.

Besides, the exchanger 1 can be controlled so that one part only of the number of elements 9 which are to be operated under normal operating conditions is actually operated at a given time or moment. Such is the case if the need for cooling is limited.

According to the invention, during a starting cycle of the exchanger 1, and as no element 9 must be defrosted, all the elements 9 are momentarily made operational until a satisfactory given temperature is reached for the air flow at the battery 5, 6 outlet and in enclosure 3.

For example, in the case of a battery 5, 6 which comprises three elements 9, the momentarily implemented refrigerating output is equal to one and a half the entire nominal output of the exchanger 1.

In the case of the embodiment shown in FIG. 1, the starting output is higher by 25% than the entire nominal output of the exchanger 1, with, additionally, selective refrigerant or cool transfer fluid circulation or non-circulation means 14 in each element 9 of the battery 5,6.

Such means 14 are such that the circulation is provided for the cold-producing elements 9 and the circulation is not authorised or not provided for the defrosting elements 9.

The selective means 14 comprise valves 15 or similar and control means 16 of said valves 15.

Valves 15 are associated with the various elements 9.

The selective means 14 are located either on the inlet 11 side of elements 9 of the battery 5,6 or on the outlet 12 side.

The circuit 2 includes at least several branches 17 connected in parallel, and their number is equal to that of the elements 9 of the battery 5, 6. One branch 17 corresponds to each element 9.

In the embodiment shown in FIG. 1, the circuit 2 partly includes several branches 17 connected in parallel on the inlet 11 side, and one single branch 18 on the outlet 12 side. In an alternative solution, not shown, a single bundle of several branches may be substituted for the single branch 18.

In another alternative solution, not shown, the circuit 2, on its entirety, includes several branches such as branch 17.

Reference is now more specifically made to FIG. 1 which relates to an installation intended for a refrigerant fluid. The exchanger 2 is then an evaporator since it allows for a change in the phase of the refrigerant fluid for a gaseous phase at the inlets 11 and for a liquid phase at the outlets 12.

In such embodiment, a single expansion valve 19 is provided on branch 18. Such expansion valve 19 also allows for a change in phase. From liquid, upstream, the refrigerant fluid changes into a gaseous phase, downstream.

A refrigerant fluid manifold distributor 20 is interposed downstream from the expansion valve 19 and between the single branch 18 and the plurality of branches 17 connected in parallel.

The circuit or exchanger 2 also comprises refrigerating means 21 which are capable of drawing the refrigerant fluid, under a low pressure, from a manifold distributor 22 connecting the outlets connected in parallel 12,—in such a case, upstream from the release valve 19.

In the case of an installation intended for a cool transfer fluid, there is no release valve such as 19 and the means 21 such as a pump make it possible, then, to circulate the fluid in the installation.

The installation may also include means, which are not shown, such as a probe, a clock and a calculator whose function is to detect the frosting degree of the elements 9 during cold-producing operations as well as the defrosting degree of the elements 9 during defrosting operations. Such detection means may be coupled with the selective refrigerant or cool transfer fluid circulation or non-circulation means 14. The frosting degree may be measured, for example, through the air flow head loss in an element 9 between the inlet and the outlet. As a matter of fact, the more the heat exchanging means 6 are covered with frost, the more difficult it is for the air to flow. Head loss measuring means are then provided.

Similarly, the installation may include control means, which are not shown, air circulation means 4, which can also be coupled with the selective refrigerant or cool transfer fluid circulation or non-circulation means 14.

Finally, the installation may include temperature and/or rate sensors or detectors as well as means such as a clock or a delay time and, more generally, control or adjustment or security devices which are useful or necessary to the operation of such type of installation.

According to a possible embodiment, partitions 10 provide some retention of the water resulting from the defrosting operation. Although this is not mentioned as essential in the contemplated application, it follows that the circulating air can be humidified, to some extent, by contact with the defrosting water.

Conversely, in another embodiment, partitions 10 provide the draining of water resulting from defrosting operations. Therefore, partitions 10 are inclined with respect to a horizontal line and the defrosting water is removed at the collection low point.

In FIG. 1, the arrow F shows the fluid circulation direction in the exchanger 1 and the circuit 2. The terms upstream and downstream mentioned above refer to such direction.

Although the number of elements 9 is not theoretically limited, it will be understood that it is desirable that it remains limited, because of building considerations.

Practically, excellent results have been obtained with refrigerated display cases or chill rooms, with three, four or five elements 9.

This allows for a potential additional starting output which is respectively equal to one half, one third and one quarter of the entire nominal power of the exchanger.

Naturally, the invention also includes the case when several batteries 5, 6 connected in series or in parallel are provided.

FIG. 2 shows a part of the installation comprising the exchanger 1 and the air circulation means 4, which is intended for being located at a negative room temperature. For example, such part is the enclosure which is intended for being kept at a negative temperature.

The considered part of the installation comprises a housing 23 attached to a wall 24 which forms a ceiling. The arrangement of the exchanger and the installation which it is included in, is shown in FIG. 2 and is similar to that shown in FIG. 1.

Accordingly, the particularities only of FIG. 2 are disclosed herein.

In such embodiment, the exchanger comprises, in addition to the composing elements disclosed hereabove, selective air circulation or non-circulation means 25 on the heat exchanging means of each element 9.

The means 25 are such that the circulation of air is authorised for some elements 9 and is not authorised for other elements.

The selective means 25 comprise mobile flaps 26 or similar associated with control means. Such control means are, more particularly, the means 16 provided in connection with the selective refrigerant or cool transfer fluid circulation or non-circulation means 14.

The control means are such that the selective means 25 are controlled in such e manner that the circulation of air is authorised for the cold-producing elements 9 and is not authorised for the defrosting elements.

In the embodiment shown in FIG. 2, the exchanger of the installation further comprises heating means 27 of the heat exchanging means 6. The heating means 27 are associated with each of the elements 9 of the battery. They are also associated with the control means of the selective means 25. The control of the heating means 27 is such that such heating means are activated (i.e. heating) for one element 9 for which the circulation of air is not authorised (defrosting element) and are inactivated for one element 9 for which the circulation of air is authorised (cold-producing element).

Accordingly, the heating means 27 are functionally coupled with the selective air circulation or non-circulation means 25.

The mobile flaps 26 of the selective means 25 can be rotatably connected between an extreme open position and an extreme closed position. In FIG. 2, four flaps **26*a* are in open position and one flap 26*b*** is in closed position.

Preferably, flaps 26 are located upstream with respect to the general air flow shown by arrow D.

Another series of flaps can be disposed downstream from elements 9, with a view to completely isolating the element (s) under defrosting progress from the air flow.

According to an alternative embodiment, which is not shown, the selective means 25 are in the form of fans. A fan is provided for each element 9. When operating, the fans provide the air flow. When stopped, one fan prevents or any way hampers the air flow in the corresponding element.

The heating means 27 can be the object of various alternative embodiments. According to one possible embodiment, these means are heating resistors or blown hot air.

In the embodiment illustrated in FIG. 2, each of the partitions 10 includes collection means 28 for the water resulting from defrosting operations and draining means 29 for such water are also provided.

FIG. **2*a* shows an exchanger such as that shown in FIG. 2, with a vertical wall 30 rather than a horizontal wall 24**.

According to such arrangement, the air circulation means 4 are placed in the upper position whereas the partitions 10 ere placed in the lower position. In such embodiment, the partitions 10 are generally in vertical position.

The water resulting from the defrosting operations fall downwards and can be collected in a tank 31 provided with draining means 32.

FIGS. 1, 3, 4 and 5 show the manifold distributor 20 in an embodiment in which it provides two functions. The first function consists in distributing the refrigerant or cool transfer fluid to the branches 17 connected in parallel. The second function consists in making it possible to turn off the flow of refrigerant or cool transfer fluid in each branch 17, independently.

The manifold distributor 20 comprises a fluid 1 inlet 33 which communicates with a distribution chamber 34. Such distribution chamber communicates with a plurality of outlets 35 opposite inlet 33.

Valves 15 are disposed close to outlets 35.

Outlets 35 are connected to branches 17 of the installation.

The manifold distributor 20 is fitted with electrovalves 36, whose coils are mounted on armature jackets 37, and a dismountable plate 38 is firmly attached to said jackets 37. Each jacket 37 is sealed onto the plate 38. One core or armature 39 which can move according to the direction of arrow N is illustrated in low position in FIG. 5 and shuts the outlet of the manifold distributor when the coil is powered on. The core or armature 39 opens the passage or outlet of the fluid when the coil is powered off.

The duct leading from the installation refrigerating equipment and opening into chamber 34 is preferably made of metal and soldered or welded on the manifold distributor 20.

I claim:

1. In a refrigerating exchanger for a refrigeration facility, comprising, in a circuit, a refrigerating or heat removing fluid circulation assembly connected to a heat exchanger assembly having a large surface area; said assemblies being disposed in the form a battery with several layers and several rows arranged in a plurality of similar elements, connected in parallel, and separated by partitions which provide heat insulation and collection of water resulting from defrosting operations, each element including at least one layer, a respective inlet and outlet forming part of the circulation assembly, the improvement wherein the battery comprises at least three elements, and a single expansion valve common to the elements, connected on a single branch of the circuit and located upstream from the inlet of the elements, a plurality of branches connected in parallel and located downstream from said expansion valve; each of said elements connected to one of the branches connected in parallel having a refrigerating capacity which is a fraction of the entire exchanger nominal output, such that at a given time of the exchanger operation at least one of the elements can be in a defrosting mode, while at least two of the elements can be in a refrigerating mode, said elements alternating between the defrosting mode and the refrigerating mode.

2. A refrigerating exchanger according to claim 1, further including air circulation means on the heat exchanging assembly so arranged as to form a common air flow at the battery inlet and a common air flow at the battery outlet.

3. A refrigerating exchanger according to claim 2, wherein the air circulation means comprise at least one fan interposed on an air flow common to the battery.

4. A refrigerating exchanger according to claim 1, wherein the elements constitute a compact assembly.

5. A refrigerating exchanger according to claim 1, wherein the partitions include a means for one of retaining and draining water resulting from defrosting operations.

6. A refrigerating exchanger according to claim 2, further comprising means for selectively allowing and preventing air circulation on the heat exchanging assembly of each element, such that air circulation is selectively authorized for some elements and not authorized for other elements.

7. A refrigerating exchanger according to claim 6, wherein said means for selectively allowing and preventing air circulation comprise mobile flaps operatively associated with control means.

8. A refrigerating exchanger according to claim 6, wherein the facility has a negative temperature, and the means for selectively allowing and preventing air circulation are arranged in such a manner that air circulation is authorized for the elements in the refrigerating mode, and not authorized for the elements in the defrosting mode.

9. A refrigerating exchanger according to claim 8, wherein each of the elements of the battery includes heating means operatively associated with control means so as to be activated for one element for which air circulation is not authorized, and to be inactivated for one element for which air circulation is authorized.

10. A refrigerating exchanger according to claim 1, further including, downstream from the expansion valve, means for selectively allowing refrigerant fluid circulation and non-circulation in each element of the battery in such a manner that refrigerant fluid circulation is provided for the elements in the refrigerating mode, and not provided for the elements in the defrosting mode.

11. A refrigerating exchanger according to claim 10, wherein the means for selectively allowing refrigerant fluid circulation and non-circulation comprise valves operatively associated with control means disposed downstream from the expansion valve.

12. A refrigerating exchanger according to claim 1, wherein the number of branches connected in parallel is equal to the number of elements.

13. A refrigerating exchanger according to claim 10, further comprising a refrigerant fluid manifold distributor interposed between the expansion valve and the plurality of branches upstream from the means for selectively allowing refrigerant fluid circulation and non-circulation.

14. A refrigerating exchanger according to claim 1, wherein the exchanger is associated with a cooling enclosure, with air circulation means for circulating air in the enclosure and providing air passage to the heat exchanging assembly.

15. Process for controlling the refrigerating exchanger according to claim 1, which comprises:

making at least two of the elements in the refrigerating mode operational in a given cycle N of the exchanger, while at least one of the elements is in the defrosting mode;

starting another similar cycle N+1 upon completing of the defrosting mode, wherein at least one of the element in the refrigerating mode in cycle N is switched to a defrosting operation, while at least one element in the defrosting mode in cycle N is switched to a cold-producing refrigerating mode, and wherein during a starting cycle of the exchanger, as no element needs to be defrosted, making all the elements momentarily operational until a satisfactory given temperature is reached for the air flow at the outlet.

16. Process for controlling the refrigerating exchanger according to claim 1, which comprises:

making at least two of the elements in the refrigerating mode operational in a given cycle N, while at least one of the elements is in the defrosting mode;

starting another similar cycle N+1 upon completing of the defrosting mode, wherein at least one element in the refrigerating mode in cycle N is switched to a defrosting operation, while at least one element in the defrosting mode in cycle N is switched to a cold-producing refrigeration mode, and controlling the switching from a cycle to the following cycle either through a previous adjustment or through the defrosting degree of the heat exchanging assembly measured through the air flow head loss in an element between the inlet and the outlet.

* * * * *

UNITED STATES PATENT AND TRADEMARK OFFICE

CERTIFICATE OF CORRECTION

PATENT NO. : 5,704,221

DATED : January 6, 1998

INVENTOR(S) : Francois LEGO

It is certified that error appears in the above-indentified patent and that said Letters Patent is hereby corrected as shown below:

On the title page, Item [54], in the title of the invention, change "REFRIGERATION" to --REFRIGERATING--.

Signed and Sealed this

Thirty-first Day of March, 1998

Bruce Lehman

*Attest:*

BRUCE LEHMAN

*Attesting Officer*

*Commissioner of Patents and Trademarks*